United States Patent [19]

Kurth

[11] Patent Number: 4,940,201

[45] Date of Patent: Jul. 10, 1990

[54] YARD PLASTIC BAG HOLDER

[76] Inventor: Orville Kurth, 271 Rangeline Rd., Mosinee, Wis. 54455

[21] Appl. No.: 349,206

[22] Filed: May 8, 1989

[51] Int. Cl.[5] ..... B65B 67/12

[52] U.S. Cl. ..... 248/101; 248/156

[58] Field of Search ..... 248/95, 97, 99, 100, 248/101, 125, 156, 122, 545

[56] References Cited

U.S. PATENT DOCUMENTS

| | | | |
|---|---|---|---|
| 203,891 | 5/1878 | Conway | 248/97 |
| 570,343 | 10/1896 | Skreberg | 248/97 |
| 1,664,658 | 4/1928 | Blazer | 248/101 |
| 3,796,402 | 3/1974 | Trotta | 248/101 |
| 3,866,872 | 2/1975 | Burgess . | |
| 3,955,722 | 5/1976 | Bard | 248/125 |
| 4,312,489 | 1/1982 | Paetzold . | |
| 4,319,726 | 3/1982 | Andersson . | |
| 4,358,083 | 11/1982 | Haubrich . | |
| 4,702,445 | 10/1987 | Ivory . | |
| 4,708,307 | 11/1987 | Daigle . | |

FOREIGN PATENT DOCUMENTS

| | | | |
|---|---|---|---|
| 439894 | 2/1912 | France | 248/97 |
| 463176 | 4/1951 | Italy | 248/97 |
| 587752 | 5/1977 | Switzerland | 248/99 |
| 9397 | 10/1908 | United Kingdom | 248/97 |

*Primary Examiner*—Ramon O. Ramirez
*Assistant Examiner*—Robert A. Olson
*Attorney, Agent, or Firm*—A. Robert Theibault

[57] ABSTRACT

A bag holder is disclosed which is insertable into the ground surface, and which includes a bag holding ring which is pivotable between a folded, nonuse position, and an open use position. The ring is also vertically adjustable to accomodate different size of bags.

5 Claims, 1 Drawing Sheet

YARD PLASTIC BAG HOLDER

TECHNICAL FIELD

My invention relates to a yard plastic bag holder for supporting a plastic bag with its mouth in the open position to receive leaves, trash and grass after mowing or other items to be removed from the lawn or park area to make a neat area free from debris such as leaves and other unwanted trash.

BACKGROUND ART

Heretofore, many forms of lawn, leaf and trash bag supports have been devised to support leaf bags on lawns for collection of leaves and trash. The closest art known to me prior to this application are: The patent to Lloyd E. Burgess, U.S. Pat. No. 3,866,872; U.S. Pat. No. 4,312,489 to William F. Paetzold; U.S. Pat. No. 4,319,726 to Gustav V. Andersson; U.S. Pat. No. 4,358,083 to Raymond O. Haubrich; U.S. Pat. No. 4,702,445 to Brian R. Ivory; and U.S. Pat. No. 4,708,307 to Rosaire Daigle.

DISCLOSURE OF THE INVENTION

In accordance with my invention I provide a yard plastic bag holder including a vertical support post having a pointed lower end for piercing the ground, a folding adjustable, partial ring including spring clips for holding the upper open end of the plastic bag and a foot bracket and a top hand grip for assisting in insertion of the vertical support post into the ground. The partial ring is adjustably mounted so that the diameter of the ring can be increased or decreased to accommodate different size bags by moving and locking the ring support closer to or further away from the ground and the ring can be rotated and locked in place against the support post for flat storage.

BEST MODE FOR CARRYING OUT THE INVENTION

Figure 1:
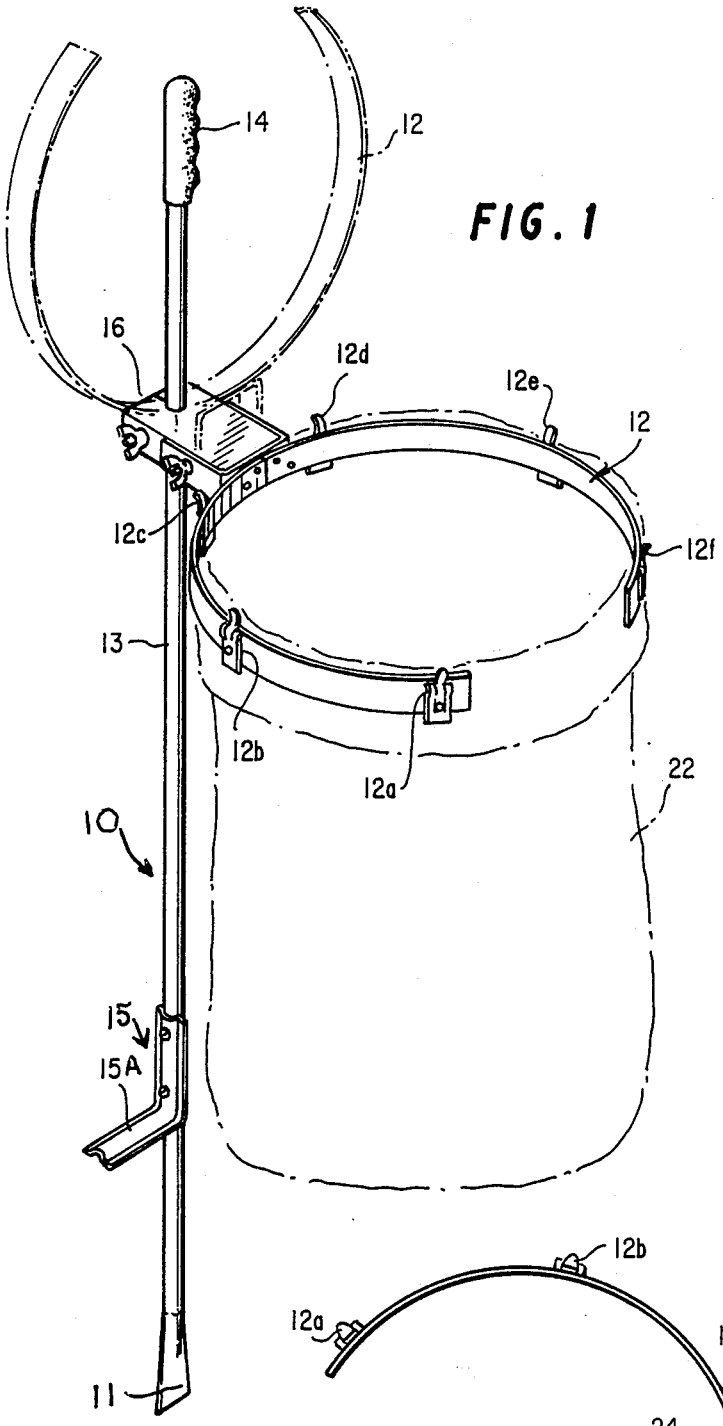
FIG. 1, is a perspective view of the yard plastic bag holder of my invention with a bag shown in chain line thereon with the bag holder arms in raised for storing position.
Figure 3:
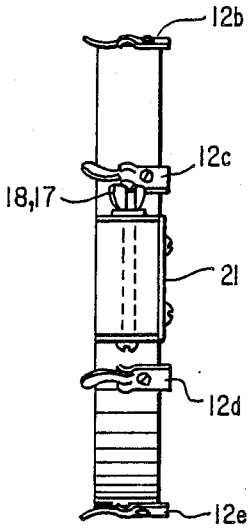
FIG. 3, is a vertical end elevational view of the apparatus of FIG. 2 taken from the right hand end of FIG. 2.

Referring now to FIG. 1, 10 designates the yard plastic bag holder of my invention having a vertical bag support post 13 having an upper handle 14 to be grasped by the installer to direct the pole 13 for driving its bottom into the ground.

The bottom end of post 13 is flattened at 11 for ground piercing positioned above the flattened portion 11 is a foot bracket 15 having a post attachment by bolts and nuts which are secured to the post 13 and which bracket 15 has a foot step 15A which the installer may step upon to drive the . flattened end 11 into the earth. The upper end of the post 13 has a hand grip 14 which is grasped by the installer as he steps upon the foot bracket 15A to drive the flat bottom 11 of the pole into the ground, as guided by the hand grip 14.

Figure 2:
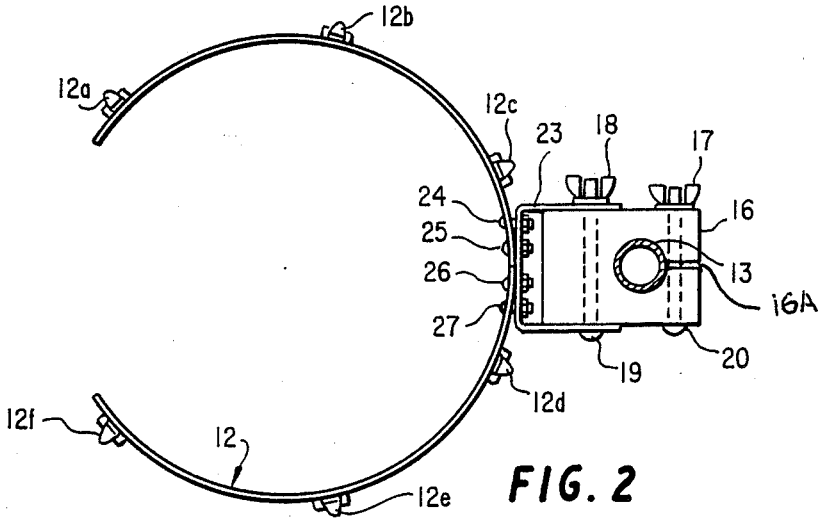
FIG. 2, is a top plan view of the apparatus of FIG. 1.

Carried by and movable along the post 11 is a split adjustment block 16 which as best seen in FIGS. 1 and 2, is slidable along the post 13. There are two threaded bolts 19, 20 which pass through two bores passing through the block 16, one to each side of the post 13. Because of the split 16A in block 16 the bolt 20 with wing nut 17 will compress the block 16 locking it to the post 13 at the desired position along the post 13, dependent upon the length of the bag to be employed. The bag support arms 12 are secured to the U-shaped bracket 23 by bolt and nut connections 24, 25, 26 and 27, and may be enlarged or diminished to accommodate different size bags. Threaded bolt 19 passes through a bore in block 16 and has a wing nut 18 for tightening it to retain the U-shaped bag support 23 in either the lowered solid line position of FIG. 1 or the chain line raised position for flat storage.

The plastic bag 22 is retained in place on the arms 12 by snap fasteners 12*a*, 12*b*, 12*c*, on one arm and fasteners 12*d*, 12*e* and 12*f* on the other arm. The snap fasteners are manufactured by LUDWIG Manufacturing Company, Inc., Racine, Wis., 53403.

The bag 22 is placed inside the arcuate arms 12 with its bottom resting upon the ground and the snap fateners engage the top of the bag to retain it in place in an open position on the arms 12 to receive the material to be discarded as best seen in FIG. 1.

When the invention is to be stored in a shed or the like the U-shaped bracket 23 is rotated to the vertical and the wing nut 18 is tightened so that the device will take up a minimum of space and a plurality of bag holders may be stacked in storage either vertically or horizontally.

What I claim is:

1. A yard plastic bag holder comprising a vertical bag support post, a split rectangular adjustment block slidable along said support post, a pair of bag support arms one of each of which is secured to a U-shaped bracket having a pair of parallel sides pivotally connected to said split block, pivot threaded bolt and nut connection means passing through said split adjustment block for adjusting said block along said support posts, and snap clips secured to said bag support arms and positioned thereon to engage the plastic bag and support same with its mouth open to receive trash.

2. A yard plastic bag holder comprising a vertical bag support post having a handle at its upper end and a ground insertion means at the other end, a split rectangular adjustment block slidable along said bag support post, bag support means secured to said block, a U-shaped post attaching member having a pair of parallel sides pivotally secured to said split block for vertical movement, said bag support member means being secured to said U-shaped member for retaining the bag in a filling position and being positionable in a raised position for storage against said support post in a raised stored position against said support post, snap clips secured to said bag support member and positioned thereon to engage the plastic bag and support same with its mouth open to receive trash, a height adjusting screw passing through said split block to the side of said split block away from said support post, and foot engageable means carried by said support post positioned to be engaged by the foot of an installer to drive the post into the ground.

3. A yard plastic bag holder as claimed in claim 2 wherein said foot engageable means is secured to said vertical bag support post positioned to be engaged by the foot of an installer lying between the earth piercing end of said post and the split adjustment block.

4. A yard plastic bag holder as claimed in claim 3, wherein said bag support means is a pair of arms secured to said U-shaped attaching member for supporting the trash bag with its mouth in the open position.

5. A yard plastic bag holder as claimed in claim 4, wherein said split adjustment block has a first and second horizontal bore therethrough, one to each side of said vertical bag support post, a first and second threaded bolt and wing nut through each horizontal bore, the bolt and wing nut passing through the split block closest to the U-shaped attaching member being for retaining the bag support in the horizontal trash receiving position and the second horizontal bore in said split block lying to the outer side of said support post being the height adjusting bolt and wing nut for retaining the split block at the desire position along said vertical bag support post.

* * * * *